United States Patent [19]

Riddle et al.

[11] Patent Number: 4,965,976

[45] Date of Patent: Oct. 30, 1990

[54] END CAP FOR EXPANSION JOINT

[75] Inventors: Jack D. Riddle, Canton; John D. Nicholas, Lawrenceville, both of Ga.

[73] Assignee: MM Systems Corporation, Tucker, Ga.

[21] Appl. No.: 411,418

[22] Filed: Sep. 22, 1989

[51] Int. Cl.[5] ..... E04B 1/62

[52] U.S. Cl. ..... 52/396; 52/403; 52/573

[58] Field of Search ..... 52/396, 403, 573; 404/47, 66, 68, 69, 56, 57

[56] References Cited

U.S. PATENT DOCUMENTS

| | | | |
|---|---|---|---|
| 1,999,861 | 4/1935 | Bowden . | |
| 3,410,037 | 11/1968 | Empson et al. | 52/403 X |
| 3,951,562 | 4/1976 | Fyfe | 52/396 X |
| 4,781,003 | 11/1988 | Rizza | 52/396 |

FOREIGN PATENT DOCUMENTS

| | | | |
|---|---|---|---|
| 232203 | 8/1987 | European Pat. Off. | 404/47 |

OTHER PUBLICATIONS

MM Systems Corporation, Systems for Seismic and Expansion Control, 1988, p. 4.

*Primary Examiner*—David A. Scherbel
*Assistant Examiner*—Creighton Smith
*Attorney, Agent, or Firm*—Jones, Askew & Lunsford

[57] ABSTRACT

An end cap is disclosed for terminating the end of a joint cover for sealing an elongated expansion joint between adjacent dynamic structures in such a manner as to permit movement of the joint while sealing the end of the joint against water and debris. The end cap includes an elongated convex elastomeric cover having portions thereon attached to each of the adjacent dynamic structures such that the convex cover spans the expansion joint between the adjacent structures to seal the joint. The end cap further comprises a transverse end wall member transverse to the direction of elongation of the expansion joint. The transverse wall member has at least one pleat formed therein transverse to the direction of movement of the joint, such that the transverse wall member folds and unfolds along the pleat as the expansion joint closes and opens.

16 Claims, 4 Drawing Sheets

END CAP FOR EXPANSION JOINT

TECHNICAL FIELD

The present invention relates generally to an apparatus for sealing expansion joints between adjacent dynamic structures while permitting kinetic movement of the joint, and relates more specifically to an apparatus for terminating the end of such a sealing device to permit movement of the joint while sealing the end of the joint against water and debris.

BACKGROUND OF THE INVENTION

As is well known, building structures are subject to numerous external kinetic forces from seismic movement, wind, thermal variations, and the like. To accommodate these forces, many building are provided with expansion joints which permit relative movement of the various wall and roof sections of the structure. Such expansion joints are capable of accommodating both functional movements, such as thermal expansion and contraction and the swaying of the structure caused by the wind, and seismic movements caused by shifts in the underlying terrain.

For both functional and aesthetic reasons, it is advantageous to seal expansion joints in such kinetically designed structures. An expansion joint seal system must serve a number of functions: it must normal joint movement, it must provide a weather tight joint, it must maintain the integrity of the joint seal during seismic movements, and it should present an aesthetically acceptable appearance. In addition, when the expansion joint is located in a roof or other horizontal plane exposed to the elements, the horizontal seal system should also resist the accumulation of water and, preferaby, deflect water away from the joint.

A typical device for sealing an expansion joint between adjacent dynamic structures in a roof or other like horizontal application comprises a convex elastomeric cover. Opposing lateral portions of the cover are secured to the adjacent dynamic structures such that the cover spans the joint between the structures to prevent water and debris from penetrating the joint. Such covers are commonly arcuate or shaped like an inverted "V", but they can be of any appropriate convex shape. A conventional manner of securing the cover to the adjacent structures is to provide a pair of elongated metal frames mounted to mutually facing portions of the structures. Locking tabs formed on lateral portions of the convex joint cover are received in longitudinal locking channels is the metal frame members to fasten the joint cover to the frames.

Under normal operation of the joint, as the joint, as the joint opens, such as would occur in response to strong winds or upon thermal contraction of the adjacent structures, the convex cover will tend to flatten out as its lateral edges, anchored to opposing sides of the joint, are pulled apart. Conversely, as the joint closes, the convex cover will tend to bow upwardly as its lateral edges are brought closer together. At all times, however, the cover spans the expansion joint between the adjacent structures to seal the joint against water and debris.

The typical prior art expansion joint seal can optionally include a secondary or seismic seal mounted within the joint beneath the convex cover. The lateral edges of this seismic seal are conventionally secured to the same frame members which retain the convex cover. The seismic seal is capable of accommodating a broader range of movement than the convex cover without becoming ruptured or dislodged. Thus, in the event that serve movement of the adjacent structures causes the joint to open further than the convex cover can accommodate, such as would occur in the event of an earthquake, the seismic seal will maintain the integrity of the expansion joint seal.

A problem associated with prior art horizontal expansion joint seals concerns terminating the convex cover in such a manner that the end of the joint is sealed against water and debris without obstructing normal joint movement. Often, the convex covers of prior art horizontal expansion joint systems have been left open at their ends, permitting normal joint movement but allowing water and debris to penetrate the joint. Other times, the end of the cover has been crudely covered by a transverse wall, which either impeded normal joint operation or separated from the cover under normal joint movement, again compromising the integrity of the seal.

Thus, there is a need to provide an improved seal system for horizontal expansion joints wherein the ends of the joint system are sealed against water and debris, while permitting normal joint movement.

There is a further need to provide an apparatus for sealing the ends of existing seal systems for horizontal expansion joints against water and debris while permitting normal joint movement.

There is still a further need to provide an end cover for a horizontal seal system which presents an aesthetically pleasing appearance.

SUMMARY OF THE INVENTION

As will be seen, the present invention overcomes these and other disadvantages associated with prior art seal systems for horizontal expansion joints. Stated briefly, the disclosed embodiment of the present invention comprises an improved seal system for horizontal expansion joints which accommodates normal joint movement while closing the end of the seal system against water and debris.

Stated somewhat more specifically, the seal system of the disclosed embodiment comprises an elongated convex cover whose lateral edges are secured to the adjacent dynamic structures such that the cover spans the expansion joint to seal it against water and debris. The end of the convex cover terminates in an integrally formed transverse wall member having at least one pleat formed therein. As the joint opens and closes, the transverse wall member folds and unfolds along the pleat. In this manner, the end of the cover is continuously sealed against water and debris, while normal movement of the expansion joint is accommodated.

Thus, it is an object of the present invention to provide a seal system for horizontal expansion joints which provides improved sealing of the ends of the system against water and debris.

It is another object of the present invention to provide a seal system for horizontal expansion joints wherein the ends of the system are sealed against water and debris while permitting normal movement of the expansion joint.

It is a further object of the present invention to provide an apparatus for sealing the ends of existing seal systems for horizontal expansion joints against water and debris.

A further object of the present invention is to provide an apparatus which seals the ends of existing seal systems for horizontal expansion joints while permitting normal movement of the expansion joint.

Other objects, features, and advantages of the present invention will become apparent upon reading the specification, when taken in conjunction with the drawings and the appended claims.

DETAILED DESCRIPTION OF THE DISCLOSED EMBODIMENT

Figure 1:
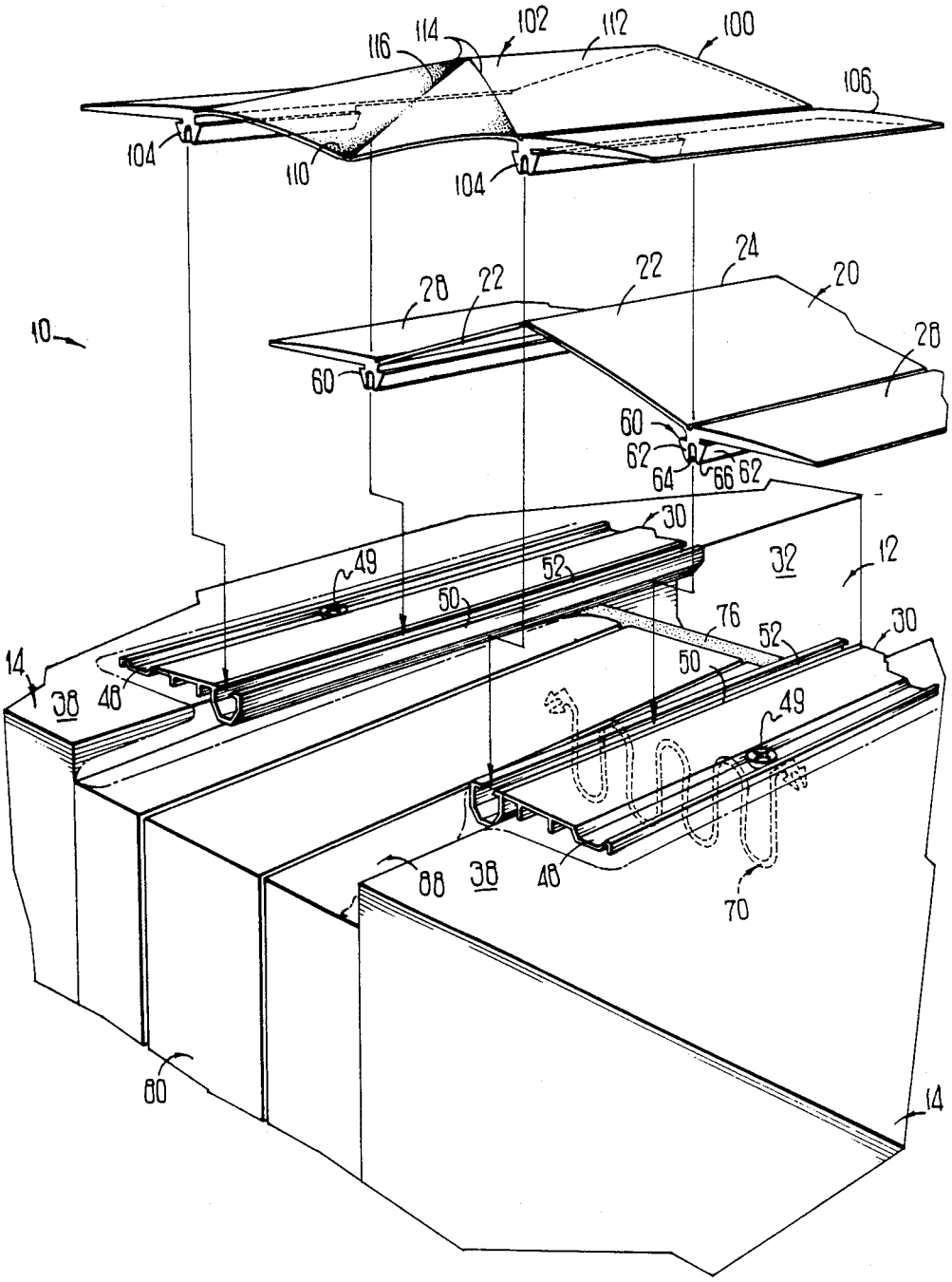
FIG. 1 is an exploded perspective view of an improved seal system for horizontal expansion joints including an end cap according to the present invention.

Referring now to the drawings, in which like numerals indicate like elements throughout the several views, FIG. 1–6 illustrate an improved seal system 10 for sealing a horizontal expansion joint 12 between adjacent roof structures 14. The seal system 10 includes a convex joint cover 20 of conventional design covering the expansion joint 12. The convex joint cover 20 comprises a pair of opposing, longitudinally extending side walls 22 which slope downward and outward from a common apex 24. In transverse cross-section, as perhaps best seen in FIG. 3, the convex cover 20 resembles an inverted "V". Extending outwardly from the lower portion of the sloping side walls 22 are a pair of flanges 28. Each flange 28 is tapered and slopes slightly downward and away from it corresponding inclined wall member 22.

Figure 3:
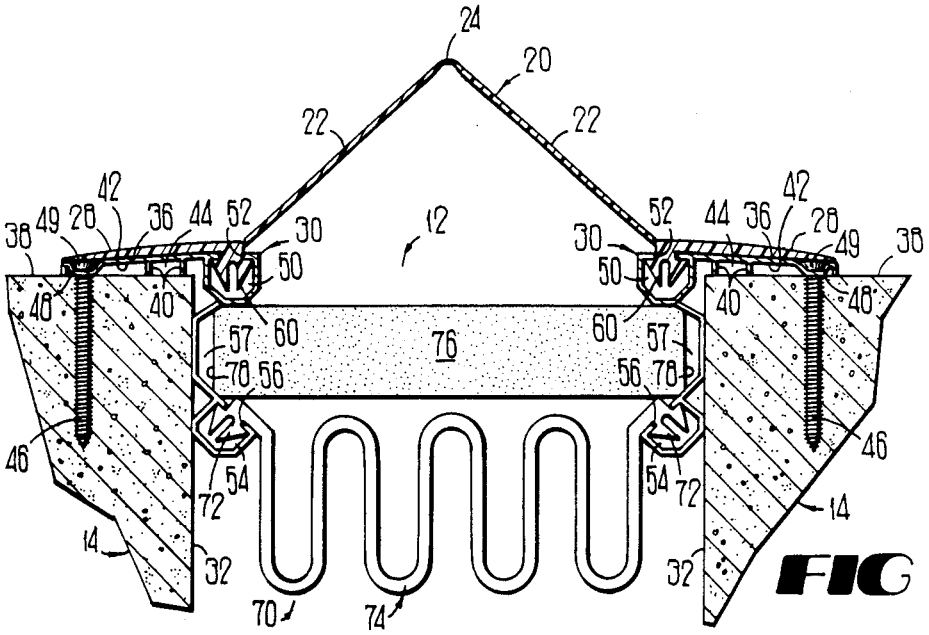
FIG. 3 is a transverse cross-sectional view of the seal system taken along section line 3—3 of FIG. 2.

The mechanism for mounting the joint cover over the expansion joint will now be discussed with respect to FIG. 3, wherein a pair of elongated metal frame member 30 are mounted within the expansion joint 12 to mutally facing wall portions 32 of the adjacent roof structures 14. At the upper end of each frame member 30 is a substantially horizontal flange 36 which engages the upper surface 38 of the corresponding roof structure 14 adjacent the expansion joint 12. The flanges 36 have short vertical spacer members 40 projecting downward from their lower surfaces 42 which define caulking grooves 44 beneath the flanges. The frame members 30 are secured to their corresponding roof structures 14 by screws 46 inserted through the flanges 36. Longitudinal channels 48 formed in the flanges 36 adjacent their outer lateral edges provide a screw slot within which the heads 49 of the screws 46 may be recessed.

At the inner end of each flange 36 and within the expansion joint 12, each frame member 30 defines an upper locking channel 50 having an upwardly facing opening 52 therein. Disposed beneath the upper locking channel 50 within the expansion joint 12, each of the frame members 30 further defines a lower locking channel 54 having an opening 56 disposed approximately 45° from the vertical and facing inwardly of the expansion joint. A recess 57 is defined between the upper and lower locking channels 50, 54.

A pair of longitudinally extending, downward projecting locking tabs or ears 60 are formed on the joint cover 20, one tab beneath each juncture between the inclined wall members 24 and their corresponding flanges 28. The locking tabs 60 engage the upper locking channels 50 of the metal frame members 30 to fasten the joint cover 20 to the frames. As can perhaps best be seen FIG. 1, each locking tab 60 is split into a pair of opposing longitudinal lobes 62 by a longitudinal vertical slot 64 formed therebetween to facilitates compression of the tabs. The lower ends 66 of the lobes 62 are beveled so that when the lobes impinge upon the lateral walls defining the upwardly facing opening 52 of the upper locking channels 50, the lobes are biased inwardly to compress the locking tabs 60, thereby permitting the tabs to pass through the relatively narrow upwardly facing opening.

Disposed within the expansion joint 12 is a seismic seal 70 of conventional design. The seismic seal 70 has longitudinal locking tabs 72 projecting outwardly and downwardly at approximately a 45° angle. The locking tabs 72 are bifurcated into lobes having bevelled outer edges, as hereinabove described with respect to the locking tabs 60 of the joint cover 20. The locking tabs 72 of the seismic seal 70 engage the lower locking channels 54 of the frame members 30 to fasten the seismic seal within the expansion joint 12. The seismic seal 70 has a pleated central section 74 which is capable of accommodating a broader range of movement than the convex joint cover 20 without rupturing or dislodging the seismic seal from the expansion joint 12. Thus, in the event that severe movement of the adjacent roof structures 14 causes the expansion joint 12 to open further than the joint cover 20 can accommodate, such as may occur in the event of an earthquake, the seismic seal 70 will maintain the integrity of the expansion joint seal.

Also disposed within the expansion joint is a sealing block 76. The sealing block 76 is maintained within the expansion joint 12 by engagement of the lateral edges 78 of the block within the recesses 57 between the upper and lower locking channels 50,54 of the frame members 30.

Figure 2:
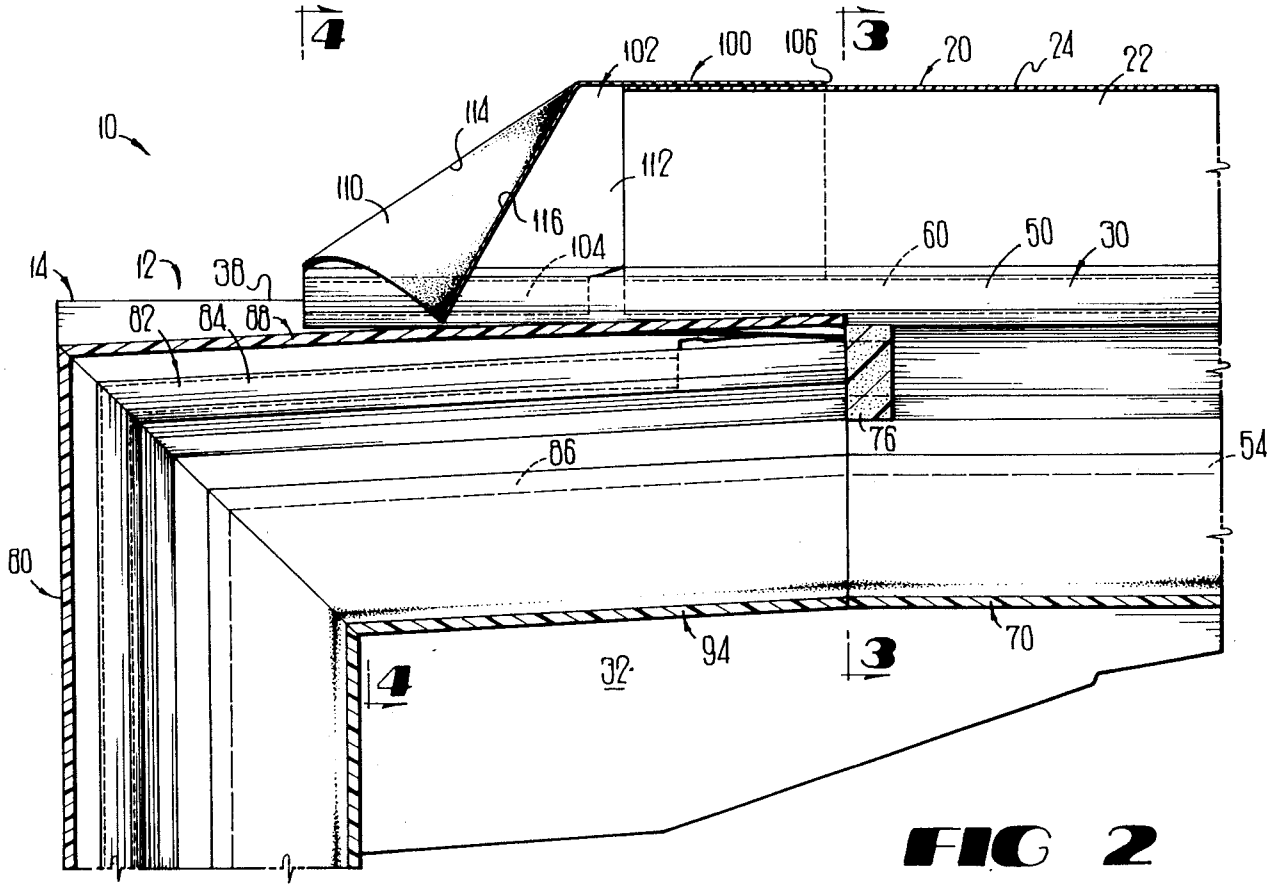
FIG. 2 is a longitudinal cross-sectional view of the seal system of FIG. 1.
Figure 4:
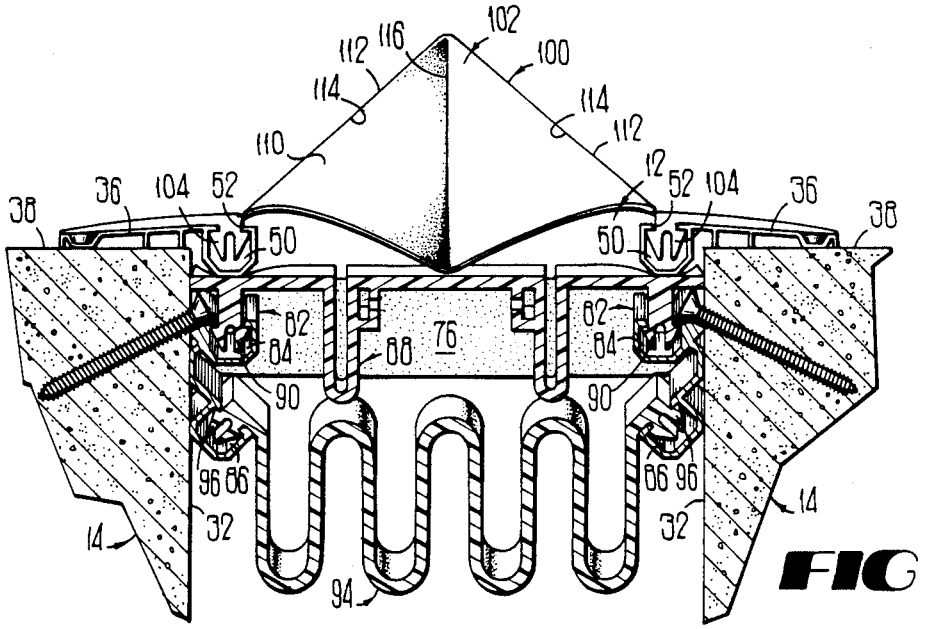
FIG. 4 is a transverse cross-sectional view of the seal system taken along section line 4—4 of FIG. 2.
Figure 5:
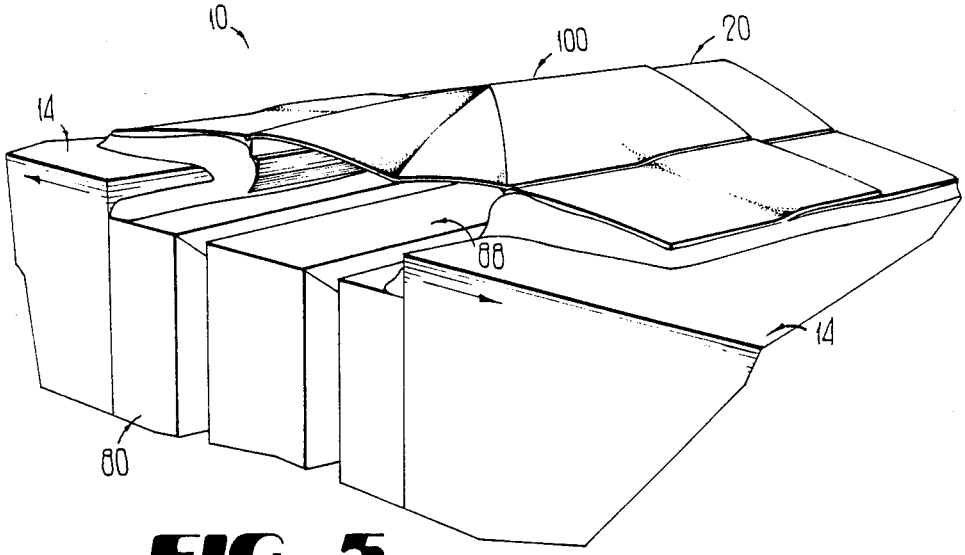
FIG. 5 is a perspective view of the seal system of FIG. 1 showing the joint in an open configuration.
Figure 6:
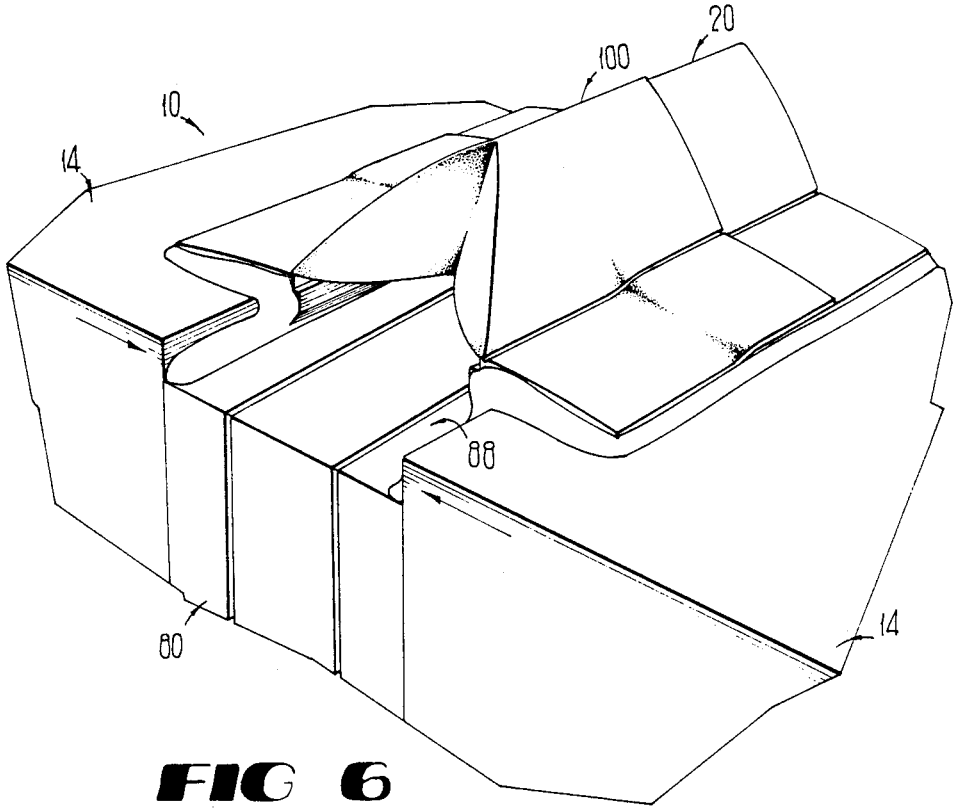
FIG. 6 is a perspective view of the seal system of FIG. 1 showing the joint in a closed configuration.

Referring now to FIGS. 2 and 4, the portion of the expansion joint 12 adjacent the end walls of the structures 14 includes apparatus for effecting a transition between the horizontal roof seal 76 and a vertical wall seal 80. A pair of downward sloping frame members 82 mounted within the expansion joint 12 to the mutually facing wall portion 32. The frame members 82 define upper and lower locking channels 84, 86 of a profile similar to the locking channels 50, 54 of the metal frame members 30. A transition seal 88 has ears 90 on either side thereof similar to the ears 60 of the convex roof seal. The transition seal 88 is fastened in place by engagement of the ears 90 within the upper locking channel 84 of the frame member 82. Located within the expansion joint 12 beneath the transition seal 88 is a seimic seal 94 having ears 96 on lateral edges thereof, as hereinabove described with respect to the seismic seal 70. Engagement of the ears 96 with the lower locking channel 86 of the frame member 82 secures the seismic seal 94 within the expansion joint 12.

Referring again to FIG. 1, the seal system 10 further comprises an end cap 100 for termining the open end of the convex joint cover 20. A major portion of the end cap 100 comprises a convex cover section 102 having an inverted "V" configuration corresponding to the shape of the joint cover 20. Like the joint cover 20, the end cap 100 has a pair of longitudinally extending, downward projecting locking tabs 104 which engage the upper locking channel 50 of the frame member 30 to fasten the end cap over the expansion joint 12. To permit the rear edge 106 of the end cap 100 to overlap the adjacent portion of the joint cover 20, the locking tabs 104 do not extends the full length of the end cap 100 but stop short of the rear edge of the end cap by a length to the desired length of overlap.

The end cap 100 has a plated transverse wall member 110 formed at its forward end. The transverse wall member 110 is formed by folding the inclined wall members 112 of the end cap 100 downward and inwardly at a 45° angle along the lines 114. The portion of the end cap which has been folded downward and inwardly is then folded along the line 116 which formerly comprised a portion of the apex 24 to form a pleat.

To install the expansion joint sealing system 10 of the present invention, the frame members 30 are first mounted to the mutually facing wall portion 32 within the expansion joint 12. The caulking grooves 44 beneath the flanges 36 of the frame members 30 are filled with caulk, and the flanges 36 are imposed against the upper surfaces 38 of the adjacent roof structures 14. The screws 46 are then inserted through the flanges 36 of the frame members 30 and into the adjacent roof structures 14 to fasten the frame members 30 in place, the heads 49 of the screws 46 being recessed into the channels 46 in the flanges. Similarly, the transition frames 82 are installed on the mutually facing wall portions 32 within the expansion joint 12.

If the application calls for a seismic seal, the seismic seals 70, 94 are installed next. The locking tabs 72 on opposing longitudinal edges of the seismic seal 70 are engaged into the lower locking channels 54 of the frame members 30, and the ears 96 of the seismic seal 94 are received within the lower locking channels 86 of the frame members 82 to fasten the seismic seals within the expansion joint. The sealing block 76 is installed next, the lateral edges 78 of the block engaging the recesses 57 between the upper and lower locking channels 50,54 of the frame members 30 to secure the block in place. The transition roof seal 88 is installed by engaging its ears 90 into the upper locking channels 84 of the transition frame members 82.

Next, the convex joint cover 20 is installed. The locking tabs 60 beneath the flanges 28 are inserted into the upwardly facing openings 52 of the upper locking channels 50 of the frame members 30. As the tabs 60 impinge upon the upper channel walls defining the opening 52, the opposing lobes 62 are biased inwardly, compressing the locking tabs 60 and permitting the tabs to enter the narrow openings 52. As the enlarged head portions of the tabs 60 pass through the openings 52, the compressive forces exerted by the lobes 62 against the walls of the channel opening 52 are removed, permitting the lobes 62 to resile outwardly. The locking tabs 60 are thereafter prevented from being retracted through the openings by engagement of the shoulder of the tabs against the upper walls of the upper locking channels 50.

With the convex joint covers 20 thus mounted, the end caps 100 are fastened over the outer ends of the joint cover 20 to terminate the joint. The locking tabs 104 of the end cap 100 engage the upper locking channels 50 of the frame members 30 in the same manner as hereinabove described with respect to the locking tabs 60 of the convex joint cover 20. The rear section of the end cap 100 overlaps the outer end of the joint cover 20. The juncture between the rear edge of the end cap 100 and the underlying portion of the joint cover 20 may than be vulcanized to seal the junction.

The operation of the joint sealing system 10 will now be described. With the system installed as described above, the end cap 100 protects the end of the expansion joint 12 from penetration by water and debris. As the joint 12 closes, the transverse wall 110 at the forward end of the end cap 100 folds along the pleat 116 to accommodate the movement of the joint. As the joint 12 opens, the pleat 116 unfolds, permitting the end cap 100 to accommodate the joint movement without compromising the integrity of the seal.

While the end cap has been disclosed by way of a transverse wall member having a single pleat, it will be appreciated that a plurality of pleats or folds can be formed in the transverse wall member to accommodate movement of the expansion joint. An advantage to be derived from the provision of a multiplicity of pleats is a reduction in the distance by which the transverse wall member must overlap the transition roof seal. With a single pleat, the full extent of the joint closure is translated into a rearward displacement of the lower end of the pleat. However when the compression is accommodated by a number of such pleats, each of the multiplicity of pleats is displaced rearwardly by a substantially smaller distance. Since the pleats are displaced rearward by a lesser amount with the addition of each pleat, a transverse wall member with a number of pleats can accommodate movement of the joint without requiring an unseemly amount of overlap.

While the foregoing embodiment has been disclosed with respect to a separate end cap 100 with fits down over the end of a separate convex joint cover 20, an advantage of the present invention is that the transverse pleated wall member can be formed by directly on the joint cover if so desired. By taking the end of the convex at its apex and folding it downward and inwardly, the pleated transverse wall member is formed integrally with the convex cover. An advantage of forming the transverse pleated wall member integrally with the convex joint cover is the elimination of a separate component and its attendant installation and vulcanization steps. On the other hand, fabrication of the transverse pleated wall member integral with the joint cover will require fabrication in the field and consequently increase the amount of skilled labor required to install the joint cover.

Finally, it will be understood that the preferred embodiment has been disclosed by way of example, and that other modifications may occur to those skilled in the art without departing from the scope and spirit of the appended claims.

What is claimed is:

1. An apparatus for sealing an elongated joint between adjacent dynamic structures, said apparatus comprising:

an elongated convex elastomeric cover having an opposing pair of lower edges and an apex, each of said lower edges of said convex being attached to a corresponding one of said adjacent dynamic structures such that said convex cover spans said joint between said adjacent structures to seal said joint, and said apex at one end of said convex cover being folded downwardly and inwardly to form a transverse wall member terminating one end of said elongated convex elastomeric cover transverse to the longitudinal axis of said joint, said transverse wall member having at least one pleat formed therein transverse to the direction of movement of said adjacent dynamic structures, such that said transverse wall member folds and unfolds along said pleat as said joint closes and opens.

2. The apparatus of claim 1, wherein said convex cover further comprises laterally projecting flanges formed on lateral portions thereof, whereby said convex cover is fastened to said adjacent dynamic structures by securing one of said laterally projecting flanges of said convex cover to each of said adjacent dynamic structures.

3. The apparatus of claim 2, wherein said laterally projecting flanges of formed on said lateral portions of said convex cover are adhesively fastened to each of said adjacent dynamic structures.

4. The apparatus of claim 2, wherein said laterally projecting flanges of formed on said lateral portions of said convex cover are comprised of an elastomeric material and are fastened to each of said adjacent dynamic structures by vulcanization.

5. The apparatus of claim 1, further comprising a pair of elongated frame members, one frame member being mountable to each of the mutually facing edges of said adjacent dynamic structures, said convex cover being secured to said adjacent dynamic structures by mechanically fastening said convex cover to said pair of elongated frame members.

6. The apparatus of claim 5, wherein each of said elongated frame members defines longitudinal grooves therein, and wherein said convex cover further comprises lobes projecting from lateral portions thereof which engage said longitudinal grooves in said elongated frame members to attach said convex cover mechanically to said elongated frame members.

7. The apparatus of claim 1, further comprising a secondary elongated elastomeric seal disposed across said joint and beneath said convex cover, whereby said apparatus will continue to seal said joint if said convex cover should become dislodged.

8. An end cap for terminating the end of an elongated convex cover, lateral portions of which cover are attached to adjacent dynamic structures to seal a kinetic joint between said adjacent dynamic structures, said cover moving with said dynamic structures as said joint opens and closes, end cap comprising:

a housing positionable contiguously with said end of said convex cover and operative when so positioned to move with said convex cover as said kinetic joint opens and closes, said housing defining an upper edge thereof; and a transverse wall for sealing said end of said convex cover, said transverse wall being formed by folding said upper edge of said housing downwardly and inwardly to form at least one pleat in said transverse wall transverse to the direction of closure of said kinetic joint such that said transverse wall folds and unfolds along said pleat as said joint opens and closes.

9. The end cap of claim 8, wherein said contiguously positionable housing is receivable within said end of said elongated convex cover.

10. The end cap of claim 8, wherein said housing circumscribes said end of said elongated convex cover when contiguously positioned with respect thereto.

11. The end cap of claim 8, wherein said housing abust said end of said elongated covex cover when contiguously positionable with respect thereto.

12. The end cap of claim 8, wherein said lateral portions of said convex cover are attached to said adjacent dynamic structures by means of tabs formed on said lateral portions of said cover which are received within slots formed on elongated frame members attached to mutually facing portions of said adjacent dynamic structures, and wherein said end cap further comprises tabs formed on lateral portions of said housing which are engageable with said slots formed on said elongated frame members attached to said mutually facing portions of said adjacent dynamic structures to attach said end cap to said convex cover.

13. The end cap of claim 8, wherein said housing further comprises laterally projecting flanges formed at the lateral edges thereof which are attachable to said adjacent dynamic structures to secure said end cap to said structures.

14. The end cap of claim 8, wherein said contiguous housing is attachable to said convex cover.

15. The end cap of claim 14, wherein said contiguous housing is attachable to said convex cover by vulcanization.

16. The end cap of claim 14, wherein said contiguous housing is adhesively attachable to said convex cover.

* * * * *